US009745931B2

(12) United States Patent
McGrew et al.

(10) Patent No.: US 9,745,931 B2
(45) Date of Patent: Aug. 29, 2017

(54) FUEL SYSTEM WITH A FUEL PUMP CONTROL MODULE AND A HEAT SINK

(71) Applicant: DELPHI TECHNOLOGIES, INC., Troy, MI (US)

(72) Inventors: Jeffrey L. McGrew, Cicero, IN (US); Michael J. McHale, El Paso, TX (US); Gary A. Hiner, Fishers, IN (US); Timothy A. Vas, Kokomo, IN (US); Raul I. Quiroz, Chihuahua (MX); Ricardo R. Dorado, Chihuahua (MX)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 14/955,548

(22) Filed: Dec. 1, 2015

(65) Prior Publication Data

US 2017/0152823 A1 Jun. 1, 2017

(51) Int. Cl.

| | |
|---|---|
| ***F01P 3/12*** | (2006.01) |
| ***F02M 53/00*** | (2006.01) |
| ***F02M 37/10*** | (2006.01) |
| ***F02M 37/00*** | (2006.01) |
| ***F02D 41/30*** | (2006.01) |
| ***F01P 3/16*** | (2006.01) |
| *F01P 3/00* | (2006.01) |

(52) U.S. Cl.

CPC ..... *F02M 53/00* (2013.01); *F01P 3/12* (2013.01); *F01P 3/16* (2013.01); *F02D 41/3082* (2013.01); *F02M 37/0017* (2013.01); *F02M 37/0047* (2013.01); *F02M 37/10* (2013.01); *F01P 2003/005* (2013.01); *F01P 2070/52* (2013.01); *F02M 2200/247* (2013.01)

(58) Field of Classification Search

CPC F01P 3/12; F01P 3/16; F01P 2003/005; F01P 2070/52

USPC ..... 123/41.31, 549, 557

See application file for complete search history.

(56) References Cited

U.S. PATENT DOCUMENTS

| | | | | |
|---|---|---|---|---|
| 5,038,741 | A | 8/1991 | Tuckey | |
| 5,092,748 | A | 3/1992 | Simmons | |
| 5,454,697 | A | 10/1995 | Nakanishi | |
| 5,613,844 | A | 3/1997 | Tuckey et al. | |
| 6,877,488 | B2 * | 4/2005 | Washeleski | B60K 15/03504 123/41.31 |
| 7,106,593 | B2 | 9/2006 | Stabile et al. | |
| 7,263,978 | B2 * | 9/2007 | York | F04B 49/20 123/41.31 |

(Continued)

FOREIGN PATENT DOCUMENTS

| | | | |
|---|---|---|---|
| JP | S6235088 | A | 2/1987 |
| JP | 2008291701 | A | 12/2008 |

*Primary Examiner* — Erick Solis

(74) *Attorney, Agent, or Firm* — Joshua M. Haines

(57) ABSTRACT

A fuel system for an internal combustion engine includes an electric fuel pump; a conduit which defines a flow path through which fuel flows from the electric fuel pump to the internal combustion engine; a fuel pump control module with electronics which drive the electric fuel pump, the fuel pump control module being disposed within a compartment defined by a wall; and a heat sink in thermal contact with the fuel pump control module and extending out of the compartment through an aperture of the wall and into the flow path such that the heat sink is sealed to the wall, thereby preventing fluid communication through the aperture.

11 Claims, 3 Drawing Sheets

(56) References Cited

U.S. PATENT DOCUMENTS

| | | | | |
|---|---|---|---|---|
| 7,458,365 | B2 | 12/2008 | Hazama | |
| 7,497,207 | B2 * | 3/2009 | Lahn | F02D 41/3082 123/497 |
| 7,808,784 | B2 * | 10/2010 | Graf | B60K 15/03 165/104.33 |
| 7,827,969 | B2 | 11/2010 | Yamamoto et al. | |
| 7,854,598 | B2 | 12/2010 | Suzuki | |
| 9,234,483 | B2 * | 1/2016 | Achor | F02M 31/20 |
| 2005/0100461 | A1 | 5/2005 | Izutani et al. | |
| 2008/0053412 | A1 | 3/2008 | Suzuki | |
| 2008/0069705 | A1 | 3/2008 | Fujimoto | |
| 2008/0310976 | A1 | 12/2008 | Boutros | |
| 2012/0245819 | A1 * | 9/2012 | Graf | F02D 41/221 701/99 |
| 2014/0314591 | A1 | 10/2014 | Herrera et al. | |
| 2015/0176551 | A1 | 6/2015 | Teets et al. | |

* cited by examiner

FUEL SYSTEM WITH A FUEL PUMP CONTROL MODULE AND A HEAT SINK

TECHNICAL FIELD OF INVENTION

The present invention relates to a fuel system for an internal combustion engine; more particularly to a fuel system which includes an electric fuel pump; even more particularly to a fuel system which includes a fuel pump control module for supplying power to the electric fuel pump, and still even more particularly to a heat sink for dissipating heat from the fuel pump control module.

BACKGROUND OF INVENTION

Fuel systems for modern internal combustion engines commonly include an electric fuel pump which uses electricity as the power source to pump fuel from a fuel tank to the internal combustion engine. Some fuel systems operate by using a fuel pump control module to drive the electric fuel pump using pulse width modulation in order to cause the electric fuel pump to pump fuel to the internal combustion at a pressure that is required to satisfy the operating demands of the internal combustion engine. An engine control module determines, based on operating conditions of the internal combustion engine, a pressure that is required to operate the internal combustion engine, and the fuel pump control module varies the flow rate produced by the electric fuel pump in order to maintain the determined pressure. The fuel pump control module includes electronics which produce heat during operation thereof. In order to maintain satisfactory operation of the fuel pump control module, this heat needs to be dissipated.

In one known arrangement, a heat sink is provided in thermal contact with the fuel pump control module. The heat sink is also exposed to the atmosphere in order to transfer the heat to the atmosphere; however, the rate of heat transfer may not be sufficient to maintain a desired temperature of the fuel pump control module. In another arrangement as shown in United States Patent Application Publication No. US 2015/0176551 A1, the fuel pump control module is disposed within a compartment. A fuel conduit communicating fuel from the electric fuel pump is routed into the compartment where a heat sink is placed in thermal communication with the fuel pump control module and the heat is transferred from the heat sink to the fuel flowing through the fuel conduit. However, routing the fuel conduit into the compartment containing the fuel pump control module may be difficult to implement and fuel vapor or any liquid fuel that may leak at connections of the fuel conduit are communicated directly to the compartment.

What is needed is a fuel system which minimizes or eliminates one or more of the shortcomings as set forth above.

SUMMARY OF THE INVENTION

Briefly described, a fuel system for an internal combustion engine includes an electric fuel pump; a conduit which defines a flow path through which fuel flows from the electric fuel pump to the internal combustion engine; a fuel pump control module with electronics which drive the electric fuel pump, the fuel pump control module being disposed within a compartment defined by a wall; and a heat sink in thermal contact with the fuel pump control module and extending out of the compartment through an aperture of the wall and into the flow path such that the heat sink is sealed to the wall, thereby preventing fluid communication through the aperture. Since the heat sink extends out of the compartment, the potential for liquid fuel or fuel vapor to enter the compartment is minimized while also exposing the heat sink directly to fuel from the electric fuel pump, thereby efficiently dissipating heat from the fuel pump control module.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
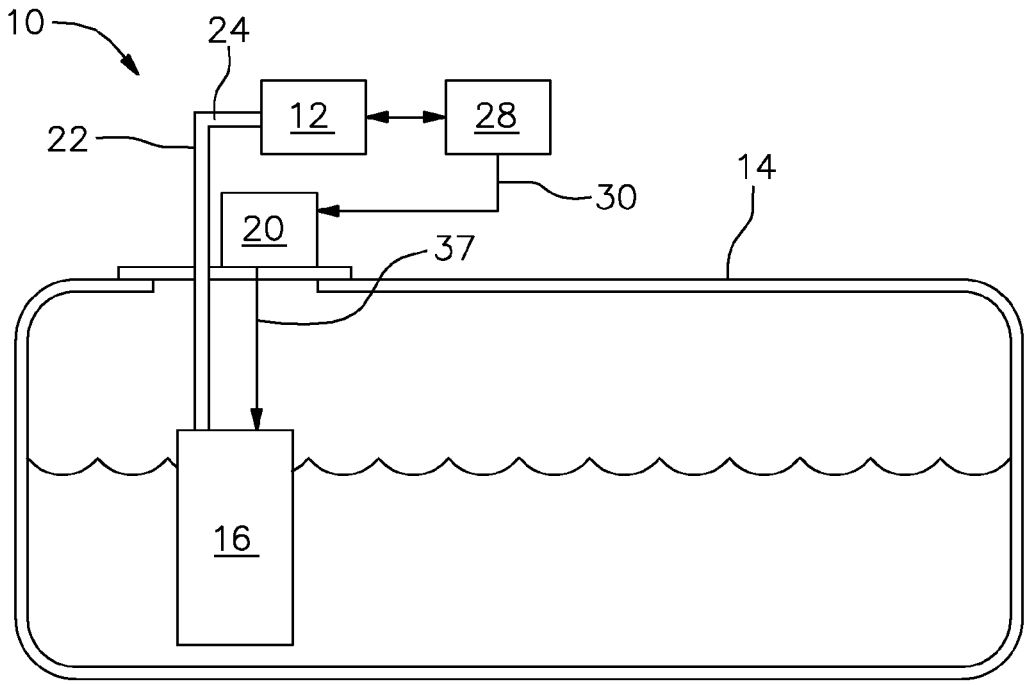
FIG. 1 is a schematic view of a fuel system in accordance with the present invention.
Figure 2:
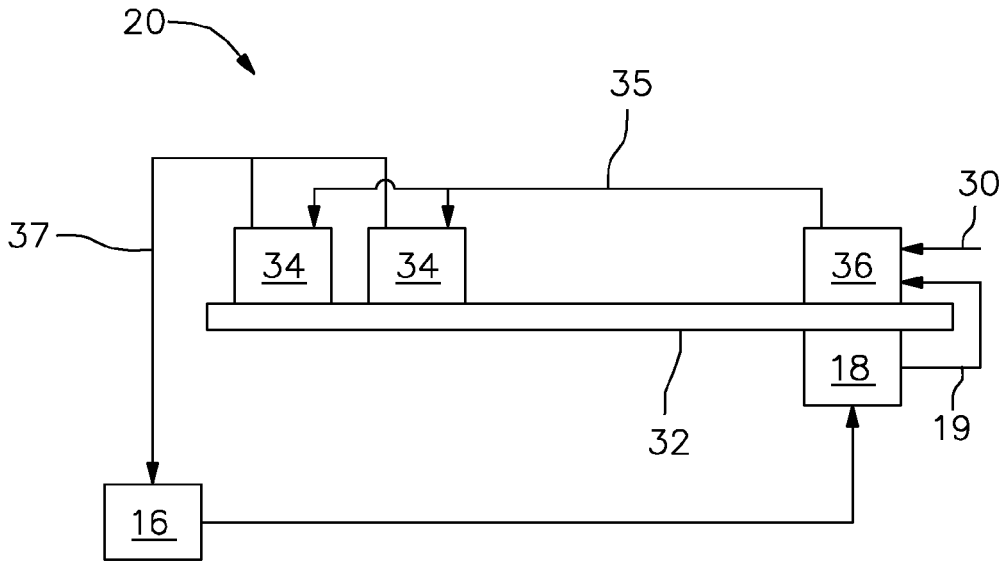
FIG. 2 is a schematic view of a fuel pump control module of the fuel system in accordance with the present invention.
Figure 3:
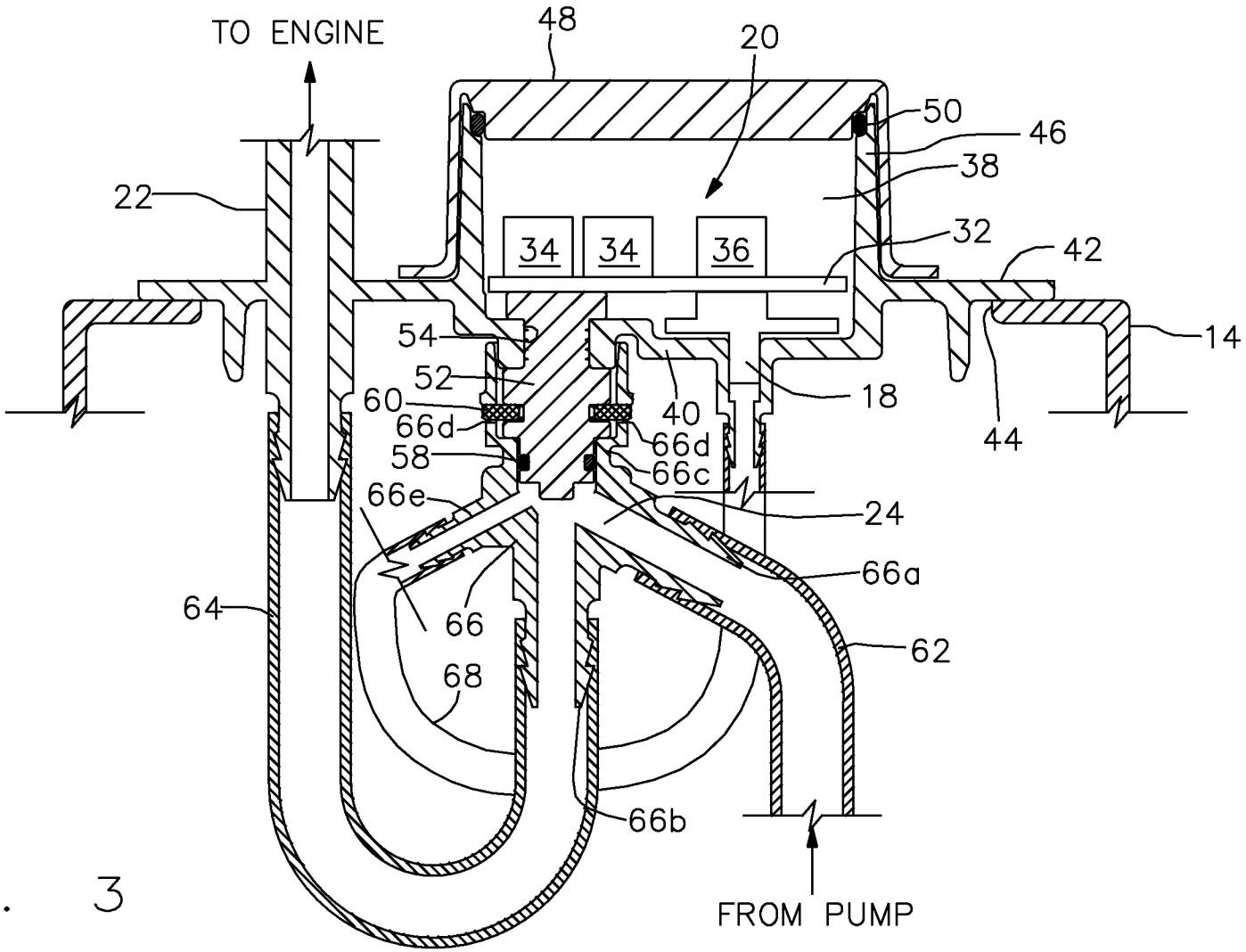
FIG. 3 is a cross-sectional view of a portion of the fuel system including a heat sink which cools the fuel pump control module.
Figure 4:
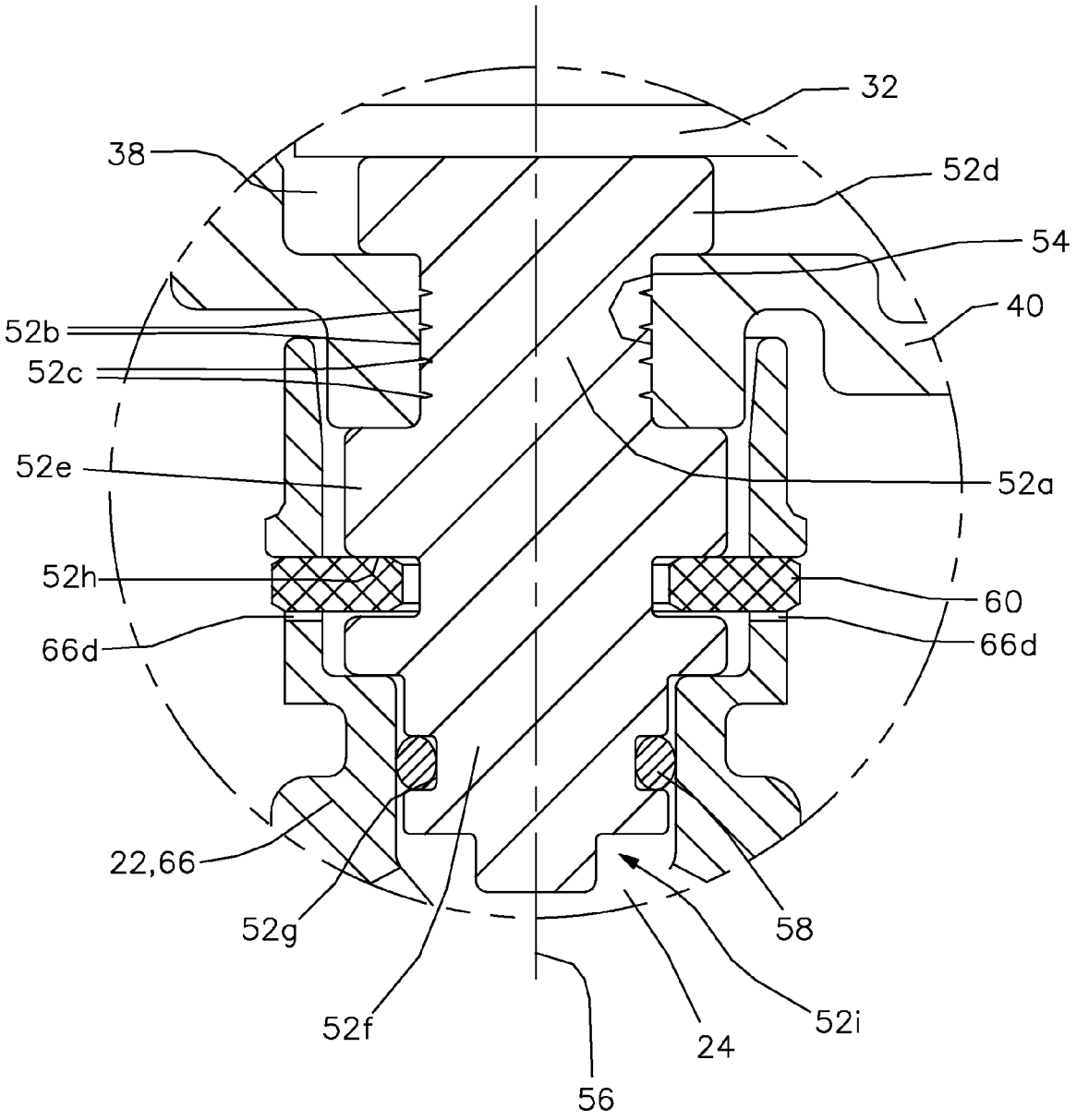
FIG. 4 is an enlarged view of a portion of FIG. 3 including the heat sink.

In accordance with a preferred embodiment of this invention and referring to FIGS. 1-4, a fuel system 10 for an internal combustion engine 12 is shown. Fuel system 10 generally includes a fuel tank 14 which holds a volume of fuel to be supplied to internal combustion engine 12 for operation thereof; an electric fuel pump 16 which pumps fuel from fuel tank 14 to internal combustion engine 12; a fuel pressure sensor 18 which produces a pressure signal 19 indicative of the pressure of fuel produced by electric fuel pump 16; a fuel pump control module 20 which supplies electrical power to operate electric fuel pump 16; and a conduit 22 which defines a flow path 24 from electric fuel pump 16 to internal combustion engine 12. Electric fuel pump 16 may take many forms which are known to those skilled in the art of electric fuel pumps, and may be, by way of non-limiting example only, impellor type; gerotor; roller vane; or gear type. Further details of electric fuel pump 16 will not be disclosed herein, however, an exemplary electric fuel pump is described in United States Patent Application Publication No. US 2014/0314591 A1, the disclosure of which is hereby incorporated herein by reference in its entirety. In use, electric fuel pump 16 may be operated to produce a desired fuel pressure of the fuel that is supplied to internal combustion engine 12. The desired pressure may change based on operating conditions and demands of internal combustion engine 12. An engine control module 28, which is in bi-directional communication with internal combustion engine 12 for receiving operating information and for controlling various subcomponents of internal combustion engine 12, may receive input from various sensors (not shown) from internal combustion engine 12 such that the input from the sensors is processed in order to determine the appropriate fuel pressure that is needed to operate internal combustion engine 12. Consequently, engine control module 28 produces and communicates a command signal 30 to fuel pump control module 20 in order to allow fuel pump control module 20 to operate electric fuel pump 16 to produce the desired fuel pressure.

Fuel pump control module 20 includes a circuit board 32 to which is mounted electronics which drive electric fuel pump 16. The electrics may include one or more power semiconductors 34 and a pump controller 36 such that pump controller 36 is coupled to fuel pressure sensor 18 in order for pump controller 36 to receive pressure signal 19. Pump controller 36 determines, based on input from fuel pressure sensor 18 and engine control module 28, a drive signal 35 and communicates drive signal 35 to power semiconductors 34. Power semiconductors 34 are switched on and off in a duty cycle, based on drive signal 35, in order to generate a drive current 37 which is communicated to electric fuel pump 16. Consequently, the duty cycle is increased in order to achieve a greater fuel pressure for a given flow output of electric fuel pump 16 while the duty cycle is decreased in order to achieve a lower fuel pressure for a given flow output of electric fuel pump 16. Also consequently, the duty cycle is increased in order to accommodate greater flow output of electric fuel pump 16 for a given fuel pressure while the duty cycle is decreased in order to accommodate lesser flow output of electric fuel pump 16 for a given fuel pressure. Power semiconductors 34 may be, by way of non-limiting example only, MOSFETS, SCR's, thyristors, or dedicated power drivers such as half-bridge or full-bridge power drivers. Heat is generated as a result of operation of fuel pump control module 20, and consequently, this heat must be dissipated as will be described in greater detail in the paragraphs that follow.

Fuel pump control module 20 is enclosed within a compartment 38 which is defined, at least in part by a first wall 40. As illustrated, first wall 40 may be defined by a cover 42 which closes off an opening 44 of fuel tank 14 which accommodates insertion of electric fuel pump 16 within fuel tank 14. Compartment 38 is further defined by a second wall 46 which is generally annular in shape and which extends in a generally perpendicular direction from first wall 40 from a side of first wall 40 that faces away from the interior of fuel tank 14. Compartment 38 is closed by a compartment cover 48 which traverses the end of second wall 46 that is distal from first wall 40. Compartment cover 48 may be sealed to second wall 46, by way of non-limiting example only, by a first O-ring 50 which is compressed between second wall 46 and compartment cover 48. In this way, compartment 38 is sealed, thereby preventing foreign matter, that may not be compatible with the operation of fuel pump control module 20, from entering compartment 38.

In order to dissipate heat from fuel pump control module 20, a heat sink 52 is provided in thermal contact with fuel pump control module 20. Heat sink 52 extends from compartment 38 through an aperture 54 in first wall 40. Heat sink 52 also extends into flow path 24, thereby placing heat sink 52 in direct contact with fuel that is flowing through conduit 22. In this way, heat sink 52 is continually exposed to fresh fuel which is able to extract heat from heat sink 52, thereby cooling fuel pump control module 20. Heat sink 52 is made of a material having high thermal conductivity, and may preferably be made of a metal such as brass or anodized aluminum that are able to tolerate corrosive fuels such as fuel containing alcohol. As defined herein, high thermal conductivity is defined to be greater than or equal to about 15 watts per meter per Kelvin ($W \cdot m^{-1} \cdot K^{-1}$). Further details and features of heat sink 52 will be described in greater detail in the paragraphs that follow.

Heat sink 52 extends along a heat sink axis 56 such that heat sink 52 is preferably a body of revolution about heat sink axis 56, i.e. the shape of a cross section of heat sink 52 by a plane perpendicular to heat sink axis 56 is a circle. Heat sink 52 includes a main body 52*a* which is sealed to aperture 54, by way of non-limiting example only, by overmolding first wall 40 to heat sink 52, thereby placing main body 52*a* in intimate, uninterrupted circumferential contact with first wall 40, and thereby preventing fluid communication through aperture 54. In order to assist in sealing main body 52*a* to aperture 54, main body 52*a* may have a plurality of alternating annular ribs 52*b* and annular grooves 52*c* (only select ribs 52*b* and grooves 52*c* are labeled in FIG. 4), thereby forming a tortuous path between heat sink 52 and first wall 40 because the material used to form first wall 40 is allowed to flow into grooves 52*c* during the overmolding operation, thereby causing grooves 52*c* to be filled by first wall 40. Heat sink 52 also includes a first heat sink flange 52*d* which extends radially outward from main body 52*a* and a second heat sink flange 52*e* which extends radially outward from main body 52*a* such that second heat sink flange 52*e* is offset relative to first heat sink flange 52*d* along heat sink axis 56. First heat sink flange 52*d* is located on the side of first wall 40 that faces toward compartment 38 while second heat sink flange 52*e* is located on the side of first wall 40 that faces toward the interior of fuel tank 14. First wall 40 is in intimate contact with first heat sink flange 52*d* and second heat sink flange 52*e*, thereby mechanically retaining heat sink 52 to first wall 40 by capturing a portion of first wall 40 axially between first heat sink flange 52*d* and second heat sink flange 52*e*. First heat sink flange 52*d* is also the portion of heat sink 52 that most directly interfaces with fuel pump control module 20 in order to place fuel pump control module 20 in thermal contact with heat sink 52. A heat dissipation region 52*f* extends axially from second heat sink flange 52*e* in a direction that is opposite from main body 52*a*. Heat dissipation region 52*f* extends into flow path 24 thereby transferring heat from fuel pump control module 20 to fuel that is flowing through flow path 24. Heat dissipation region 52*f* may include an annular O-ring groove 52*g* which is centered about heat sink axis 56. A second O-ring 58 is located within O-ring groove 52*g* such that second O-ring 58 is radially compressed between heat sink 52 and conduit 22, thereby preventing leakage of fuel between heat sink 52 and conduit 22. Heat dissipation region 52*f* may also include an annular retention groove 52*h* which is centered about heat sink axis 56 and is located axially between second heat sink flange 52*e* and O-ring groove 52*g*. Retention groove 52*h* receives a retention clip 60 therein in order to retain conduit 22 to heat sink 52 as will be described in greater detail later. As shown, heat dissipation region 52*f* may include a step 52*i* in order to maximize the area that is contacted by fuel flowing through flow path 24.

Conduit 22 may comprise a fuel pump outlet tube 62, an engine supply tube 64, and a tubing connector 66 which provides fluid communication from fuel pump outlet tube 62 to engine supply tube 64. It should be noted that fuel pump outlet tube 62, engine supply tube 64, and tubing connector 66 are located within fuel tank 14. Tubing connector 66 includes a tubing connector inlet port 66*a* which is sealed, for example by interference fit, to fuel pump outlet tube 62 and a tubing connector outlet port 66*b* which is sealed to engine supply tube 64, for example by interference fit. In this way, fuel can flow from fuel pump outlet tube 62 to engine supply tube 64 through tubing connector 66. Tubing connector 66 also includes a tubing connector heat sink port 66*c* within which heat dissipation region 52*f* is disposed such that heat dissipation region 52*f* is exposed to fuel flowing from fuel pump outlet tube 62 to engine supply tube 64 through tubing connector 66. Tubing connector heat sink port 66*c* may include opposing slots 66*d* extending therethrough. Consequently, retention clip 60 extends through slots 66*d* into retention groove 52*h*, thereby locking heat sink 52 to tubing connector 66 in the direction of heat sink axis 56. It should be noted that second O-ring 58 is compressed radially between the interior of tubing connector heat sink port 66*c* and heat sink 52, thereby preventing fuel from leaking between heat sink 52 and tubing connector heat sink port 66*c*. However, in the event that some fuel is allowed to leak past second O-ring 58, the fuel is harmlessly contained within fuel tank 14. Tubing connector 66 may also include a tubing connector pressure sensor port 66*e* to which is sealed, for example by press fit, a pressure sensor tube 68 which communicates to fuel pressure sensor 18. In this way, fuel pressure sensor 18 is exposed to the fuel in tubing connector 66 in order to sense the pressure of the fuel.

In an alternative connection between heat sink 52 and tubing connector 66, heat sink 52 may interface with tubing connector heat sink port 66*c* in an interference fit. In this way, O-ring groove 52*g*, second O-ring 58, retention groove 52*h*, retention clip 60, and slots 66*d* may be omitted.

In use, fuel pump control module 20 receives input from fuel pressure sensor 18 and engine control module 28 to command power semiconductors 34 with a duty cycle, thereby turning power semiconductors 34 on and off to supply electricity to electric fuel pump 16 in order to supply fuel from fuel tank 14 at a desired pressure to internal combustion engine 12. In operation, fuel pump control module 20 generates heat which is transferred to heat sink 52, and consequently to fuel that is passing through flow path 24 of conduit 22. Since heat sink 52 extends out of compartment 38, the potential for liquid fuel or fuel vapor to enter compartment 38 is minimized while also exposing heat sink 52 directly to fuel from electric fuel pump 16, thereby efficiently dissipating heat from fuel pump control module 20. Furthermore, since heat sink 52 extends into and connects with tubing connector 66 within fuel tank 14, any fuel that may leak between the interface of heat sink 52 and tubing connector 66 is contained within fuel tank 14.

While this invention has been described in terms of preferred embodiments thereof, it is not intended to be so limited, but rather only to the extent set forth in the claims that follow.

We claim:

1. A fuel system for an internal combustion engine, said fuel system comprising:

an electric fuel pump;

a conduit which defines a flow path through which fuel flows from said electric fuel pump to said internal combustion engine;

a fuel pump control module with electronics which drive said electric fuel pump, said fuel pump control module being disposed within a compartment defined by a wall; and a heat sink in thermal contact with said fuel pump control module and extending out of said compartment through an aperture of said wall and into said flow path such that said heat sink is sealed to said wall, thereby preventing fluid communication through said aperture;

wherein said heat sink includes a main body such that the circumference of said main body is in intimate, uninterrupted circumferential contact with said aperture, thereby preventing fluid communication through said aperture; and wherein said main body defines a plurality of alternating annular ribs and annular grooves such that said annular grooves are filled by said wall, thereby forming a tortuous path between said heat sink and said aperture.

2. A fuel system for an internal combustion engine, said fuel system comprising:

an electric fuel pump;

a conduit which defines a flow path through which fuel flows from said electric fuel pump to said internal combustion engine;

a fuel pump control module with electronics which drive said electric fuel pump, said fuel pump control module being disposed within a compartment defined by a wall; and a heat sink in thermal contact with said fuel pump control module and extending out of said compartment through an aperture of said wall and into said flow path such that said heat sink is sealed to said wall, thereby preventing fluid communication through said aperture; wherein:

said heat sink includes a main body such that the circumference of said main body is in intimate, uninterrupted circumferential contact with said aperture, thereby preventing fluid communication through said aperture;

said heat sink extends along a heat sink axis;

said heat sink includes a first heat sink flange which extends radially outward from said main body;

said heat sink includes a second heat sink flange which extends radially outward from said main body; and said wall is captured axially between said first heat sink flange and said second heat sink flange.

3. A fuel system as in claim 2 wherein said first heat sink flange is located within said compartment and contacts said fuel pump control module.

4. A fuel system for an internal combustion engine, said fuel system comprises:

an electric fuel pump;

a conduit which defines a flow path through which fuel flows from said electric fuel pump to said internal combustion engine;

a fuel pump control module with electronics which drive said electric fuel pump, said fuel pump control module being disposed within a compartment defined by a wall; and a heat sink in thermal contact with said fuel pump control module and extending out of said compartment through an aperture of said wall and into said flow path such that said heat sink is sealed to said wall, thereby preventing fluid communication through said aperture;

wherein said conduit comprises:

a fuel pump outlet tube;

an engine supply tube; and a tubing connector which provides fluid communication from said fuel pump outlet tube to said engine supply tube, said tubing connector comprising:

a tubing connector inlet port which receives fuel from said fuel pump outlet tube;

a tubing connector outlet port which communicates fuel to said engine supply tube; and a tubing connector heat sink port which receives a portion of said heat sink, thereby placing said heat sink in direct contact with fuel that is flowing from said fuel pump outlet tube to said engine supply tube within said tubing connector.

5. A fuel system as in claim 4 wherein said heat sink include and O-ring groove within which an O-ring is disposed such that said O-ring is radially compressed between said heat sink and said tubing connector heat sink port.

6. A fuel system as in claim 4 wherein:

said heat sink includes a retention groove;

said tubing connector heat sink port includes opposing slots; and a retention clip extends through said slots and into said retention groove, thereby retaining said heat sink to said tubing connector.

7. A fuel system as in claim 4 further comprising:

a fuel tank configured to hold a volume of fuel to be pumped by said electric fuel pump, said electric fuel pump being disposed within said fuel tank, and said fuel tank having a fuel tank opening therein which accommodates insertion of said electric fuel pump within said fuel tank; and a cover which closes off said fuel tank opening;

wherein said cover defines said wall.

8. A fuel system as in claim 7 wherein said tubing connector is disposed within said fuel tank.

9. A fuel system as in claim 4 further comprising a fuel pressure sensor;

wherein said tubing connector further comprises a tubing connector pressure sensor port such that a pressure sensor tube connected to said tubing connector pressure sensor port places said fuel pressure sensor in fluid communication with said flow path.

10. A fuel system as in claim 4 wherein said heat sink is sealed to said heat sink port.

11. A fuel system as in claim 4 wherein said tubing connector does not engage said wall.

* * * * *